US006481705B1

(12) United States Patent
Okada

(10) Patent No.: US 6,481,705 B1
(45) Date of Patent: Nov. 19, 2002

(54) METHOD AND DEVICE FOR DETECTING MULTIPLE FEED

(75) Inventor: Shinya Okada, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 149 days.

(21) Appl. No.: 09/649,579

(22) Filed: Aug. 29, 2000

(30) Foreign Application Priority Data

Aug. 31, 1999 (JP) ..... 11-245899

(51) Int. Cl.[7] ..... B65H 5/22
(52) U.S. Cl. ..... 271/4.03; 271/262
(58) Field of Search ..... 271/262, 263, 271/4.03

(56) References Cited

U.S. PATENT DOCUMENTS 4,154,437 A 5/1979 Butcheck et al.
4,741,526 A 5/1988 Reed
6,053,495 A * 4/2000 Hara et al. ..... 271/258.01
6,105,959 A * 8/2000 Miyata et al. ..... 271/256

FOREIGN PATENT DOCUMENTS

| | | |
|---|---|---|
| EP | 0 087 487 | 9/1983 |
| EP | 0 779 231 | 6/1997 |
| EP | 0 888 991 | 1/1999 |

* cited by examiner

*Primary Examiner*—Christopher P. Ellis
*Assistant Examiner*—Richard Ridley
(74) *Attorney, Agent, or Firm*—Nath & Associates PLLC; Gary M. Nath; Marvin C. Berkowitz

(57) ABSTRACT

A light emitting sensor emits light toward sheets carried along a carriage path and the quantity of light transmitted through each to the sheets is detected by a light receiving sensor. A predetermined number of samples of light quantities received by the light receiving sensor are sampled for each of a plurality of sampling ranges. A multiple feed for each sample range is detected based on light quantity data sampled for each sampling range. A decision of the multiple feed of the sheets is performed based on a plurality of results of the detection of the multiple feed for the plurality of sampling ranges.

9 Claims, 8 Drawing Sheets

METHOD AND DEVICE FOR DETECTING MULTIPLE FEED

BACKGROUND OF THE INVENTION

1. Field of the Invention

This invention relates to a multiple feed detection device for detecting a feed of two or more overlapped sheets (multiple feeds) when sheets are carried along a carriage route.

2. Description of the Related Art

A sheet feed mechanism provided in, e.g., a printing machine, separates sheets loaded on a sheet feed table one by one and carries them, but two or more sheets may be carried in an overlapped state when the sheets are fed to printing drums.

Therefore, the multiple feed detection at the time of carrying the sheets is conventionally conducted by arranging a multiple feed sensor consisting of an optical sensor of transmission type over a carriage path along which the sheets are carried, and detecting the light transmission quantity depending on the paper thickness of the sheets by the multiple feed sensor. The accuracy of the multiple feed detection can be improved in such a method by covering a wide measurement range during the sheet feed detected by the multiple feed sensor (an optical sensor of a transmission type) to increase the sampling number.

Most of the sheet feed mechanisms equipped in, e.g., printing machines, carry the sheets by using two or more types of rollers which differently operate. FIGS. 5A and 5B show a view of an example of a sheet feed mechanism having a multiple feed sensor.

A sheet feed mechanism 1 shown in FIGS. 5A and 5B includes a first carrier member 5 consisting of a scraper roller 3 and a pickup roller 4 which operate for picking up each sheet 2, and a second carrier member 8 consisting of a guide roller 6 and a timing roller 7 which operate for obtaining the right timing of the sheet feed.

A multiple feed sensor (a sheet detector) 10 for detecting the multiple feed of the carried sheets 2 is provided around a carriage path 9 between the first carrier member 5 and the second carrier member 8.

The multiple feed sensors 10 are constituted by optical sensors of transmission-type including a light emitting sensor 10*a* and a light receiving sensor 10*b*. The light emitting sensor 10*a* is, for example, constituted by a light emitting diode, a laser diode, or a lamp. The light emitting sensor 10*a* is disposed at a predetermined distance apart from the carriage path 9 along which the sheets 2 are fed.

The light receiving sensor 10*b* is, for example, constituted by a photodiode. The light receiving sensor 10*b* is disposed to be opposed to the light emitting sensor 10*a* at a predetermined distance apart from the carriage path 9, e.g., in an equally spaced apart relation between the light emitting sensor 10*a* and the carriage path 9 such that the carriage path 9 along which the sheets 2 are carried is sandwiched between the sensors.

If the sheets 2 are not carried, the light emitted from the light emitting sensor 10*a* is directly received by the light receiving sensor 10*b* in the multiple feed sensor 10, whereas if the sheets 2 are carried, the light transmitted through each of the sheets 2 is received by the light receiving sensor 10*b*.

In the sheet feed mechanism 1, the sheets 2 loaded on a sheet feed table (not shown) are picked up one by one from the top by the first carrier member 5 so as to be carried, and the sheets 2 picked up by the first carrier member 5 are carried toward a printing drum (not shown) by the second carrier member 8. Whether or not the sheets 2 carried from the first carrier member 5 to the second carrier member 8 are carried in an overlapped state is then determined based on detected signals of the multiple feed sensor 10.

In a method for measuring the light transmission quantity when the sheets 2 mentioned above pass between the multiple feed sensors 10, generally, the light transmission quantity tends to increase as the distance between the sheet passing position and the light emitting sensor 10*a* becomes long. Therefore it is necessary to keep the position of the sheet passing between the multiple feed sensors 10, particularly a part of sheet through which the light transmits.

However, in such a construction that the sheets 2 are carried by the sheet feed mechanism 1 mentioned above, a slack of the sheet 2 may occur when the sheet 2 is carried from the first carrier member 5 to the second carrier member 8 as shown in FIG. 5A., and a spring of the sheet 2 may occur when the end of the sheet 2 separates from the first carrier member 5 (the pickup roller 4) as shown in FIG. 5B.

Therefore, in the conventional method, the position of the sheet passing between the multiple feed sensor 10 can not be fixed due to the above mentioned slack and spring of the sheet. Considering this, if the measured area of the sheet passing between the multiple feed sensor 10 is made broader, data sampled within the measured area may include considerable errors. As a result, only the data required to detect a multiple feed must be chosen from the sampled data.

In addition, in the conventional method, the average value of the sampled data with respect to the first sheet is regarded as a reference value, and a comparison with the reference value obtained by the one measurement is performed to detect the multiple feed. For this reason, even if the multiple feed sensor 10 senses a part of the sheet, the part on which a dust or the like adheres, to detect small quantity of the light transmission, this may be erroneously discriminated as an occurrence of a multiple feed.

SUMMARY OF THE INVENTION

Accordingly, the present invention has been accomplished in view of the above mentioned problems, and it is an object of the present invention to provide a method and a device for detecting a multiple feed capable of improving the accuracy of multiple feed detection by decreasing the frequency of the multiple feed misdetection.

To achieve the above object, according to an aspect of the present invention, there is provided a multiple feed detection device comprising: a sheet detector having a light emitting sensor and a light receiving sensor arranged in vicinity of a carriage path to detect quantity of light that has transmitted through a sheet; and a processor which controls the sheet detector to detect a predetermined number of samples of light quantities for each of a plurality of sampling ranges, detects a multiple feed for each sample range based on light quantity data sampled for each sampling range, and decides the multiple feed of sheets based on a plurality of results of the detection of the multiple feed for the plurality of sampling ranges.

In a preferred embodiment of the present invention, the plurality of sampling ranges are arranged in the direction of sheet feed, and the processor conducts the samplings for the plurality of sampling ranges sequentially at predetermined sampling start timings by means of a pair of a light emitting sensor and a light receiving sensor.

In a preferred embodiment of the present invention, a plurality of sheet detectors are arranged in a direction perpendicular to the direction of sheet feed.

In a preferred embodiment of the present invention, the processor sets a total number of the plurality of sampling ranges to be odd in advance, and decides the multiple feed when the number of sampling ranges for which the multiple feed is detected is more than half of the total number.

In a preferred embodiment of the present invention, the processor decides that the multiple feed has occurred when successive results that multiple feeds are detected are obtained starting from a front end sampling range on the sheet.

To achieve the above object, according to another aspect of the present invention, there is provided a multiple feed detection method comprising the steps of: arranging a sheet detector having a light emitting sensor and a light receiving sensor in vicinity of a carriage path to detect quantity of light that has transmitted through a sheet; controlling the sheet detector to detect a predetermined number of samples of light quantities for each of a plurality of sampling ranges; detecting a multiple feed for each sample range based on light quantity data sampled for each sampling range; and deciding the multiple feed of sheets based on a plurality of results of the detection of the multiple feed for the plurality of sampling ranges.

In a preferred embodiment of the present invention, the plurality of sampling ranges are arranged in the direction of sheet feed, and the samplings for the plurality of sampling ranges are sequentially conducted at predetermined sampling start timings by means of a pair of a light emitting sensor and a light receiving sensor.

In a preferred embodiment of the present invention, a total number of the plurality of sampling ranges is set to be odd in advance, and it is decided that the multiple feed has occurred when the number of sampling ranges for which the multiple feed is detected is more than half of the total number.

In a preferred embodiment of the present invention, it is decided that the multiple feed has occurred when successive results that multiple feeds are detected are obtained starting from a front end sampling range on the sheet.

The nature, principle and utility of the invention will become more apparent from the following detailed description when read in conjunction with the accompanying drawings.

DESCRIPTION OF THE PREFERRED EMBODIMENTS

Figure 1:
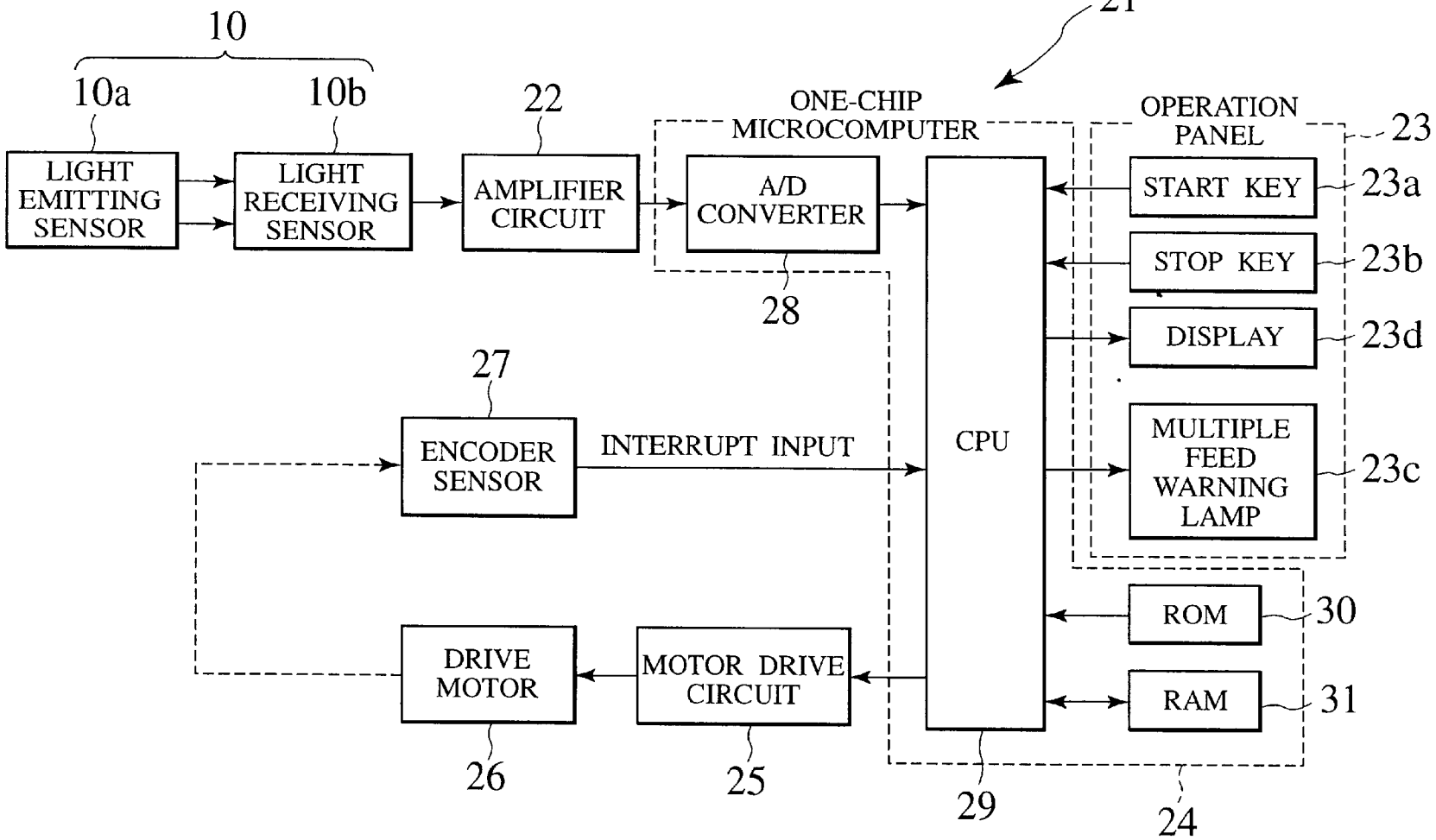
FIG. 1 shows a block diagram showing the case where a multiple feed detection device of the present invention is applied to a sheet feed mechanism of a printing machine.

FIG. 1 shows a block diagram illustrating the case where a multiple feed detection device according to the present invention is applied to a sheet feed mechanism having the constitution shown in FIG. 5. The explanation for each component of the sheet feed mechanism will be omitted.

As shown in FIG. 1, a multiple feed detection device 21 comprises a multiple feed sensor 10, an amplifier circuit 22, an operation panel 23, a microcomputer 24, a motor drive circuit 25, a drive motor 26, and an encoder sensor 27.

The amplifier circuit 22 amplifies an electrical signal in accordance with the received light quantity indicative of the light transmission quantity received from a light receiving sensor 10*b* of the multiple feed sensor 10 by a predetermined amplification factor and then supplies the amplified signal to the microcomputer 24.

The operation panel 23 may include operation keys manipulated by a user, e.g., a start key 23*a* for designating start of printing and a stop key 23*b* for designating stop of printing. A multiple feed warning lamp 23*c*, which is lit when any multiple feed (that is, two or more sheets of the sheets 2 are fed in the overlapped state) occurs, is provided on the operation panel 23. In addition, a display 23*d*, e.g., a liquid crystal display, for providing various displays such as a display of a message of the multiple feed warning is provided on the operation panel 23.

The microcomputer 24 as a processor is constituted of one-chip microcomputer including an A/D converter 28, a CPU 29, and a ROM 30 and a RAM 31.

The A/D converter 28 converts the received signal from the amplifier circuit 22 to a digital signal corresponding to the received analog signal, and supplies it to the CPU 29 as the light transmission quantity.

The CPU 29 is constituted of, e.g., a microprocessor, and conducts a carriage control of the sheets 2, setting of a sampling range at a plurality of positions in the direction of the carriage of the sheets 2, multiple feed detection of the sheets 2 according to the flow diagram shown in FIGS. 2 and 3 as explained later, etc., based on information from the operation panel 23, a signal from the amplifier circuit 22, and a signal from the encoder sensor 27. Each of the plurality of sampling range is preferably set to be narrow to some extent (for example, 20 samples, assuming that one sample corresponds to 1 mm) in order to shorten a processing time required for each sampling and decrease a capacity of memory.

As explained in more detail, the CPU 29 samples the digital signal received from the A/D converter 28 at an input timing of an interrupt signal from the encoder sensor 27 within a plurality of previously set sampling ranges. The sampling start position and the sampling end position for each sampling range set at each position are set as a count number of pulses of the encoder sensor 27 from a reference point in time of detection of the front end of the sheet 2 by the multiple feed sensor 15. In addition, if each sampling range is set in a region where the value of the light transmission amount which is the A/D converted value is stable, more reliable multiple feed detection can be achieved for a sheet 2 of large size.

The CPU 29 issues commands for controlling the drive or stop of the drive motor 26 to the motor drive circuit 25 based on the operation signals of the start key 23*a* and the stop key 23*b* on the operation panel 23.

The CPU 29 has a sheet feed counter therein, and increments by one the counts in response to an interrupt signal received from the encoder sensor 27.

Figure 2:
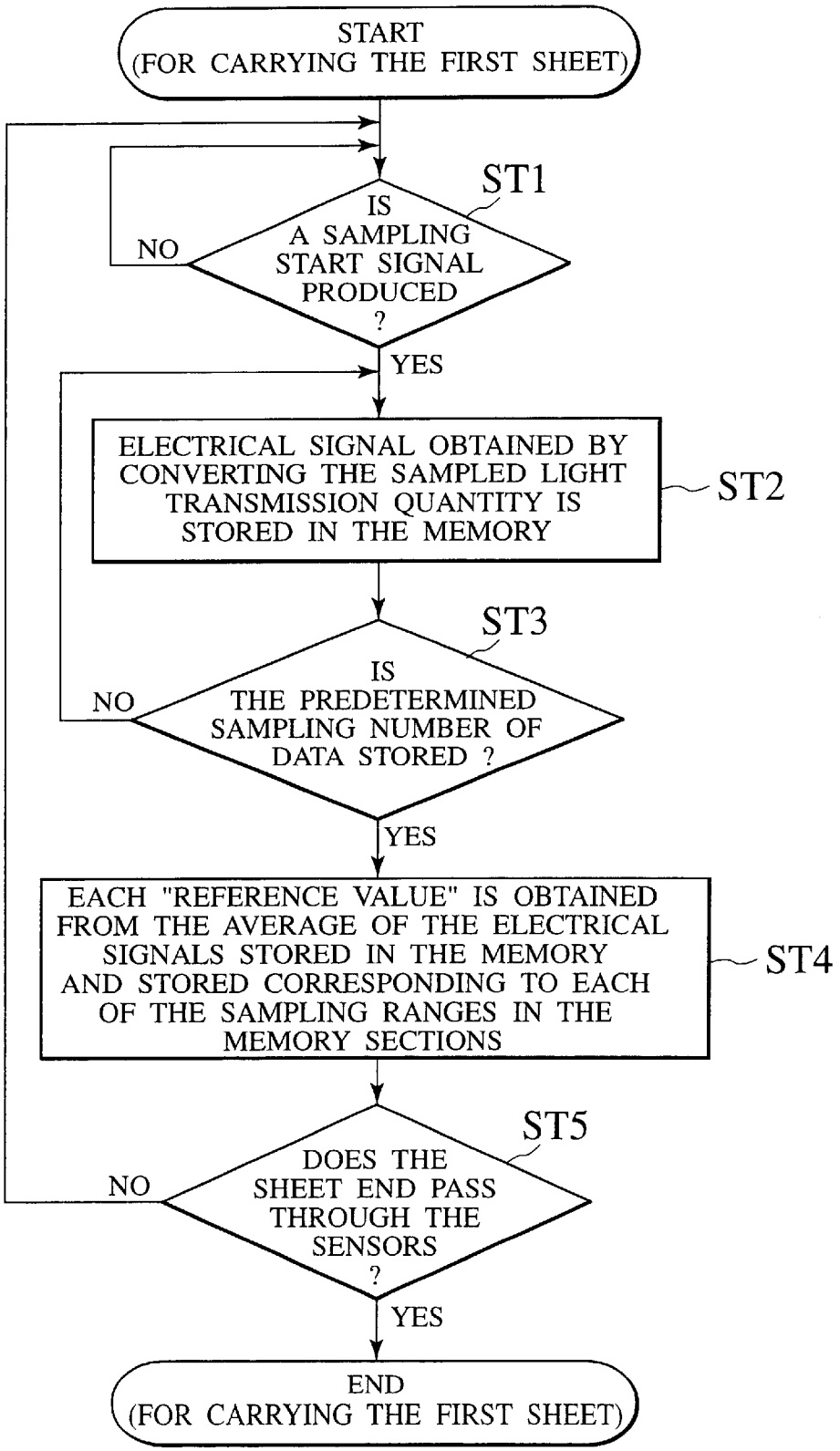
FIG. 2 shows a flow chart showing an operation when the first sheet is fed.
Figure 3:
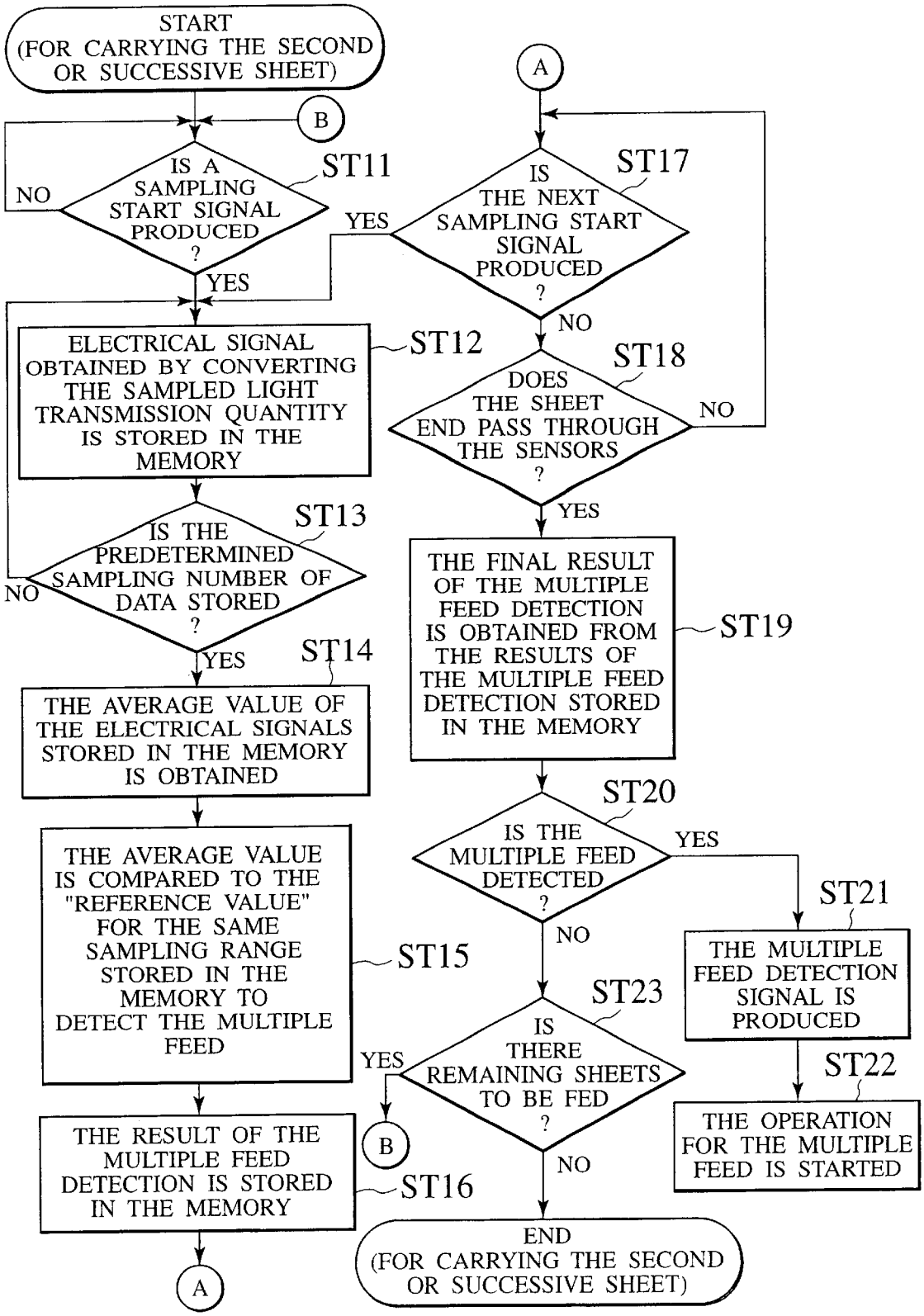
FIG. 3 shows a flow chart showing an operation when the second sheet is fed.

The ROM 30 stores processing programs necessary for conducting a sequence of processes containing the processes shown in FIGS. 2 and 3 by the CPU 29, data of the plurality of sampling ranges at plural positions in a sheet feed direction in accordance with the size of the sheets 2, etc.

The RAM 31 stores the sampling data for the first sheet of the sheets 2 within the plurality of sampling ranges at the plural positions set by the CPU 29, and also stores reference values for the respective sampling ranges. The RAM 31 successively stores, by updating, the sampling data for the second or successive sheet of the sheets 2 within the plurality of sampling ranges at the plural positions set by the CPU 29, and also stores the results of the multiple feed detection for respective sampling ranges. Further, the RAM 31 stores the counts by the sheet feed counter in the CPU 29.

The motor drive circuit 25 drives or stops the rotation of the drive motor 26 based on the commands issued by the CPU 29.

The encoder sensor 27 produces a one-shot pulse signal when the drive motor 26 rotates until a predetermined length of the sheets 2 is fed. This one-shot pulse signal is supplied as an interrupt signal to the CPU 29.

Next, operations of the multiple feed detection device 21 will be explained with reference to the flow charts shown in FIGS. 2 and 3.

The processes of the flow charts shown in FIGS. 2 and 3 are respectively executed under control of the CPU 29 in accordance with the processing programs of the ROM 30 when the sheets 2 are fed.

First of all, if the first sheet of the sheets 2 is fed and the signal for starting sampling is produced (ST1-YES), sampling of the light transmission quantity of the sheets 2 in each of the sampling ranges set at plural positions in the feeding direction of the sheets 2 is started. That is, the pulse signals of the encoder sensor 27 are counted from a reference point in time when the multiple feed sensor 10 detects the front edge of the first sheet, and if the count reaches the value of the sampling start position of each sampling range, the light transmission quantity which is converted by the A/D converter 28 via the amplifier circuit 22 from the multiple feed sensor 10 is supplied to the CPU 29. The light transmission quantity is then stored in the RAM 31 (ST2).

Next, when the count of the pulse signals from the encoder sensor 27 reaches a value corresponding to the sampling end position and thus the light quantity data of the predetermined number of samplings are stored in the RAM 31 (ST3-YES), a reference value for each sampling range is obtained from the average value of the light quantity data stored in the RAM 31, and then stored in the RAM 31 in such a manner that each reference value corresponds to each sampling range (ST4). After the end of the first sheet passes between the multiple feed sensors 10, the processing for the first sheet is terminated.

Next, in the case that the second or successive sheet of the sheets 2 is fed, similarly to the sheet feed of the first sheet, when the signal for starting sampling is produced (ST11-YES), sampling of the light transmission quantity at the first sampling range of the ranges set at the plural positions in the direction of sheet feed is started. That is, the pulse signals of the encoder sensor 27 are counted from a reference point in time when the multiple feed sensor 10 detects the front edge of the second or successive sheet, and if the count reaches the value of the sampling start position for the first sampling range, the light quantity data based on the light transmission quantity which is converted by the A/D converter 28 via the amplifier circuit 22 from the multiple feed sensor 10 is supplied to the CPU 29. The light quantity data based on the light transmission quantity is then stored in the RAM 31 (ST12).

Next, when the count of the pulse signal from the encoder sensor 27 reaches a value corresponding to the sampling end position and thus the light quantity data based on the light transmission quantities of the predetermined number of samplings are stored in the RAM 31 (ST13-YES), an average value of the light quantity data stored in the RAM 31 is calculated (ST14).

Next, the calculated average value is compared with a reference value of the light quantity data for the corresponding sampling range stored in the RAM 31 to detect the multiple feed (ST15). Here, it is determined that the multiple feed has occurred when the calculated average value is equal to or less than, for example, 75% of the reference value. The result of the multiple feed detection is then stored in the RAM 31 (ST16). The operation of the steps ST12 to ST16 is repeated every time when the next sampling start signal is produced while the end edge of the sheet does not reach the multiple feed sensor 10 (ST17, ST18).

In other words, after the multiple feed detection for the first sampling range is completed, the values of the light quantity data for the next sampling range are overwritten on the values of the light quantity data for the previous sampling range in the RAM 31. An average value of the light quantity data overwritten in the RAM 31 is then calculated, and the calculated average value is compared with the reference value of the light quantity data for the corresponding sampling range stored in the RAM 31 to detect the multiple feed detection. Such an operation is executed for all the sampling ranges which are set at the plural positions in the direction of sheet feed. The more detailed descriptions of the plurality of sampling ranges will be explained later.

After the end of the sheet 2 passes between the multiple feed sensors 10 (ST18-YES), the final result of the multiple feed detection is obtained from the results of the multiple feed detection for the sampling ranges at the plural positions stored in the RAM 31 (ST19).

In order to obtain the final result of the multiple feed detection, since there may be a case where the multiple feed is not detected for some sampling ranges while it is detected for other sampling ranges, it is necessary to previously determine conditions of the results of the multiple detection for the plurality of sampling ranges for deciding the final result of the multiple feed.

For example, the following decision methods (1) and (2) may be effective.

(1) The total number of the sampling ranges is set to an odd number. Then, if the number of sampling ranges for which a multiple feed is detected is more than half of the total number, then it is determined that the multiple feed has occurred. This decision method considers the detection results for the plurality of the sampling ranges totally to thus output a reliable result of the multiple feed detection.

(2) The occurrence of the multiple detection is determined when successive results that multiple feeds are detected are obtained starting from a front end sampling range on the sheet. This discrimination method outputs a final result of the multiple feed detection at once when successive multiple feeds for a plurality of successive sampling ranges are detected.

If the multiple feed is decided from the final result of the multiple feed detection (ST20-YES), the multiple feed detection signal is produced from the CPU 29 (ST21), and an operation for the case of multiple feed is then started (ST22). For example, after the overlappedly fed sheets are discharged onto a sheet discharge table, the feeding of the sheets 2 is stopped, and the multiple feed warning lamp 23*c* on an operation panel 23 is lit to notify the occurrence of the multiple feed to the user. If the multiple feed is not detected (ST20-NO) and the sheets 2 to be fed remains (ST23-YES), the process returns to the step ST11.

Figure 4:
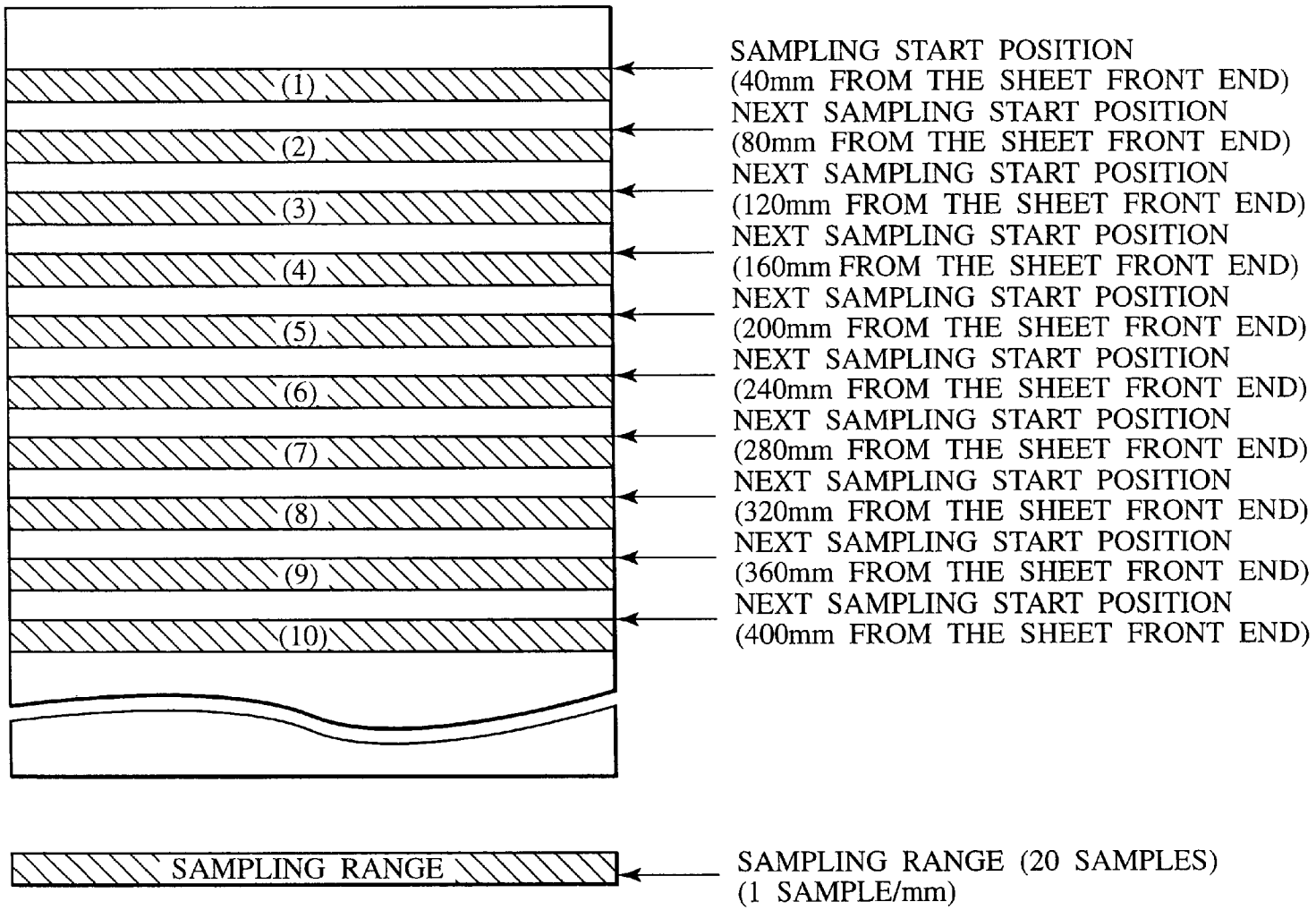
FIG. 4 shows an example of the paper size and the number of sampling areas.

Since the number of sampling ranges at the plural positions is variable in accordance with the length of the sheets 2 as shown in FIG. 4, the sampling start signal is produced accordingly on predetermined timings.

In an example shown in FIG. 4, the number of sampling ranges is variably set in accordance with the length of the sheets 2. Specifically, where the sheet has a size of A5 (148 mm×210 mm), the number in the lateral direction is set to be 3 ((1)~(3)) when the sheet is fed in the lateral direction, and the number in the longitudinal direction is set to be 3 or 4 ((1)~(3) or (1)~(4)) when the sheet is fed in the longitudinal direction. Where the sheet has a size of A4 (210 mm×297 mm), the number in the lateral direction is set to be 3 or 4 ((1)~(3) or (1)~(4)) and the number in the longitudinal direction is set to be 5 or 6 ((1)~(5) or (1)~(6)). Where the sheet has a size of A3(297 mm×420 mm), the number in the lateral direction is set to be 5 or 6 ((1)~(5) or (1)~(6)) and the number in the longitudinal direction is set to be 9 or 10 ((1)~(9) or (1)~(10)). Where the sheet has a size of B4 (257 mm×364 mm), the number in the lateral direction is set to be 5 ((1)~(5)) and the number in the longitudinal direction is set to be 7 or 8 ((1)~(7) or (1)~(8)).

Each number of the sampling range is set such that the sampling end position of the final sampling range is not overlapped with the end of the sheet.

In addition, in the case where the number of the sampling ranges is even, the number of sampling ranges is decreased by one to be set to an odd number when the decision by majority method is selected upon the final multiple feed decision.

Thus, in the above mentioned embodiments of the present invention, the samplings ranges are previously set at plural positions in the direction of sheet feed, and when the sheet 2 pass between the multiple feed sensors 10 (a light emitting sensor 10*a* and a light receiving sensor 10*b*), an average value of the predetermined number of samples of light transmission quantities for each sampling range is calculated. A reference value for each sampling range for detecting the multiple feed is obtained based on the average value of each sampling range at the time of feeding the first sheet of the sheets 2. At the time of feeding the second or successive sheet, an average value of samples for each sampling range is compared with the reference value for the corresponding sampling range to detect the multiple feed. Then, the final decision of the multiple feed is performed based on the results of multiple detection of the plurality of sampling ranges.

Figure 5A:
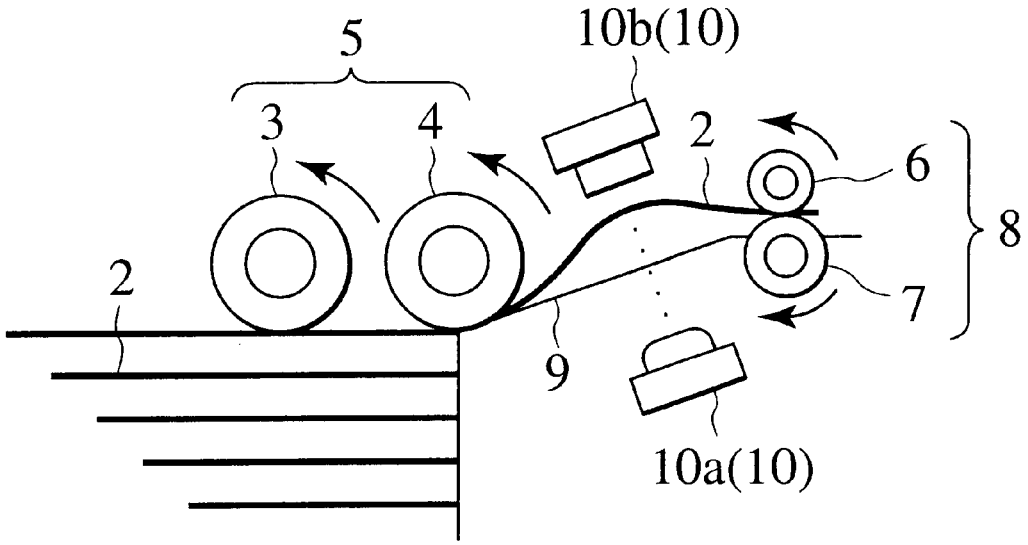
FIGS. 5A and 5B show an example of a sheet feed mechanism in a printing machine, respectively.

Therefore, as shown in FIG. 5A, even if a slack of the sheet 2 occurs when the sheets 2 are carried from the first carrier member 5 to the second carrier member 8, or a spring of the sheet 2 occurs when the end of the sheet 2 separates from the first carrier member 5 (pickup roller 4), thereby causing variation of the passing position of the sheet near the multiple feed sensors 10 dependent on the carriage state of the sheet 2, the multiple feed detection with higher reliability can be performed, since the multiple feed detection is carried out based on the data comparison with the reference values for the sampling ranges obtained under the same carriage state.

Further, unlike the conventional method in which the multiple feed detection is carried out based on the data comparison with only one reference value, according to the above embodiment, the multiple feed detection is carried out based on the data comparison with the reference values for the plurality of sampling ranges set at plural positions in the direction of the sheet feed. Therefore, the frequency of mistakes of the multiple feed detection can be reduced.

In addition, the capacity of a memory can be reduced, since the values of the light quantity data at the time of feeding the second or successive sheet of the sheets 2 are overwritten on the values of the light quantity data of the previous sheet for each sampling range. Moreover, when the invention is applied to an collator 51 to be described later, operations carried out by the CPU can be distributed thereby to the processing roads on the CPU 29.

Figure 5B:
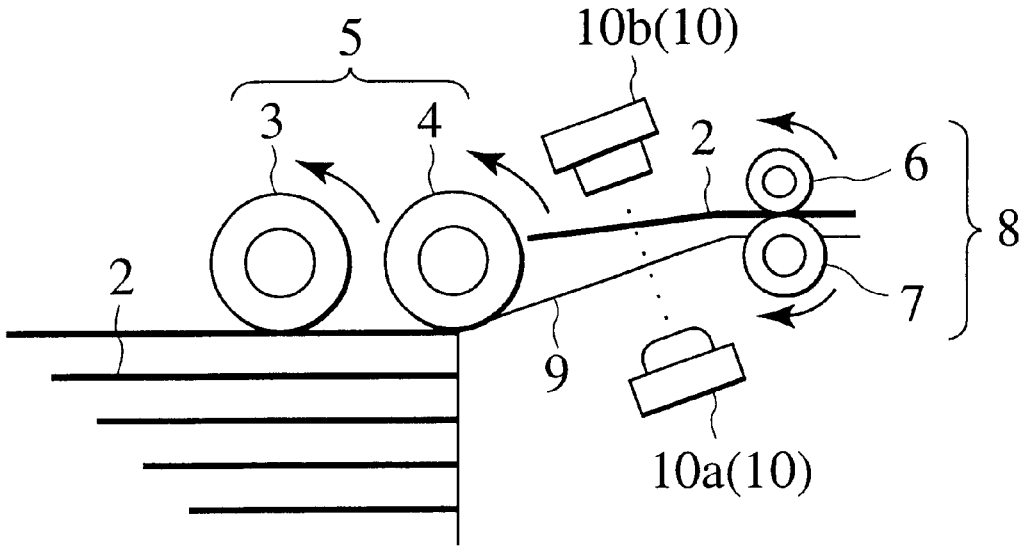

In the above mentioned embodiments of the invention, the sampling ranges set at the plural positions in the direction of sheet feed is variously set in accordance with the length of the sheets 2. For example, they may be set such that the timings of the sampling starts corresponds to the positions each separated from the adjacent one with constant distance, or they may be set to an area of a sheet, the area where the variation of the light transmission quantity (light quantity data) due to the slack and spring of the sheet as shown in FIG. 5A or 5B is less.

Figure 8:
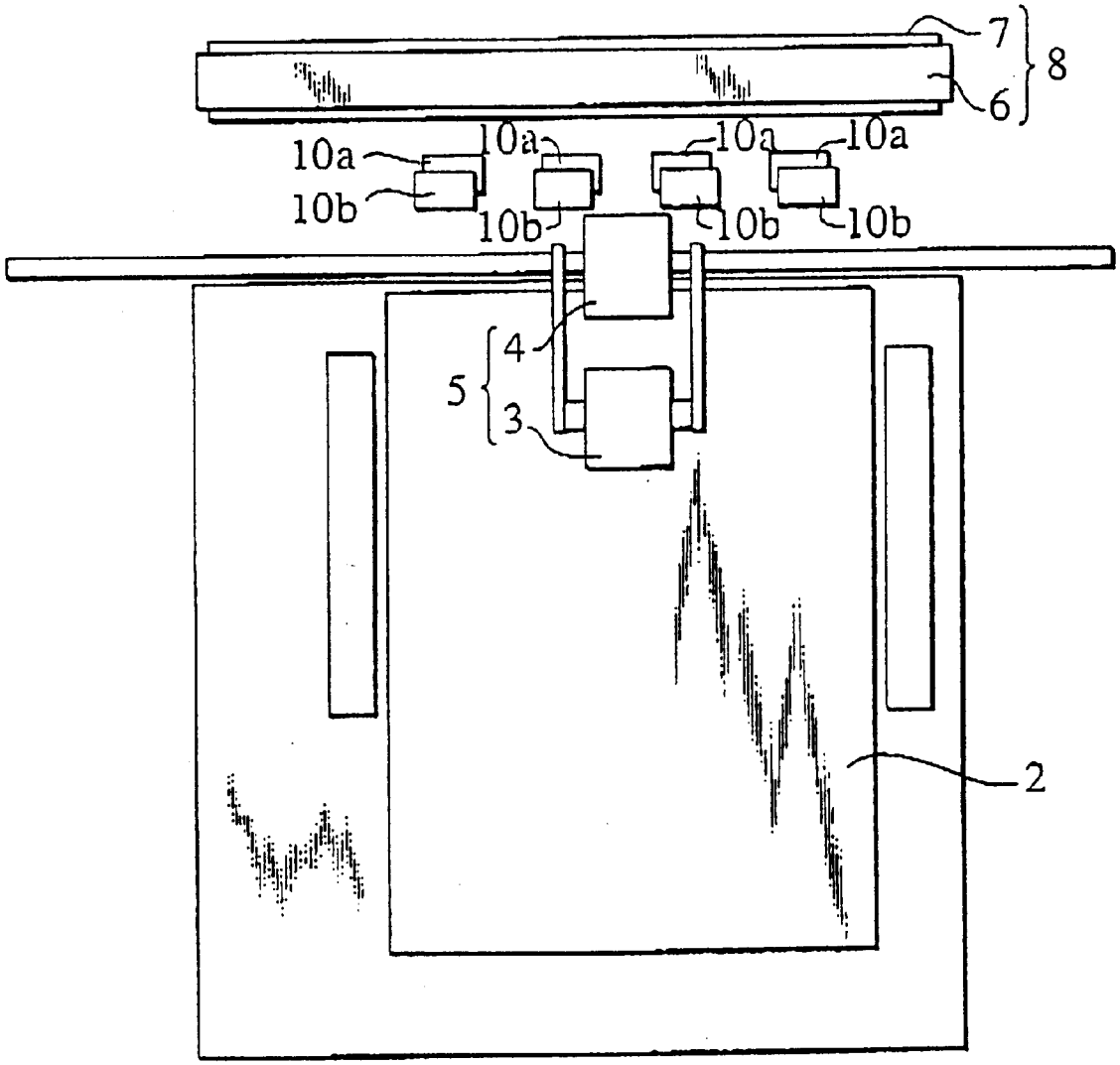
FIG. 8 shows a top view of the example of the sheet feed mechanism shown in FIGS. 5A and 5B.

Although, in the above embodiments of the present invention, explanations have been made for the case in which one multiple feed sensor 10 samples light quantity data for the plurality of sampling ranges, and the final decision of the multiple feed is made based on the plural results of multiple feed for the plurality of sampling ranges. However, another constitution as shown in FIG. 8 may be applied in which a plurality of multiple feed sensors 10 each having an emitting element and a receiving element which sandwich the sheet 2 are arranged in the direction perpendicular to the direction of sheet feed, and each of the plurality of the multiple feed sensors samples light quantity data for the plurality of sampling ranges, and then the final decision of the multiple feed is made based on all the plural results of multiple feed for the plurality of sampling ranges for the plurality of the multiple feed sensors. In this case, the operation of the flow charts shown in FIGS. 2 and 3 as stated above is executed for each of the plurality of the multiple feed sensors 10. This enables the multiple feed detection to be conducted with higher accuracy. Further, in this case, the plurality of sampling ranges set for each multiple sensor at plural positions in the direction of sheet feed may be same for every multiple sensor, or they may be different for each multiple sensor.

In the embodiments of the invention, the average value of the sampled light transmission quantities is used to detect the multiple feed for each sampling range. However, the present invention should not be limited thereto, and accordingly the same effect can be obtained by means of known methods in which the highest frequency value, the center value or the like is used.

In the embodiments of the invention, the multiple feed sensors 10 are a pair of light emitting and receiving sensors of light transmission type arranged to be opposed to each other and to sandwich the sheets 2 carried along the carriage path 9. However, it is intended that the present invention not be limited thereto, and accordingly a pair of light emitting and receiving sensors of reflection type arranged at one side of the carriage path can be used also. In this case, of course, the value of the analog-to-digital converted electrical signal is not the light transmission quantity but the light reflection quantity.

In the above mentioned embodiments of the invention, the explanation was made for the example in which the present invention is applied to the sheet feed mechanism 1 shown in FIG. 5. However, the present invention should not be limited to this constitution, and accordingly it may be applied to a collator for making bundles of desired copies of sheets by overlapping and collating a plurality of different sheets in order from the first page.

Figure 6:
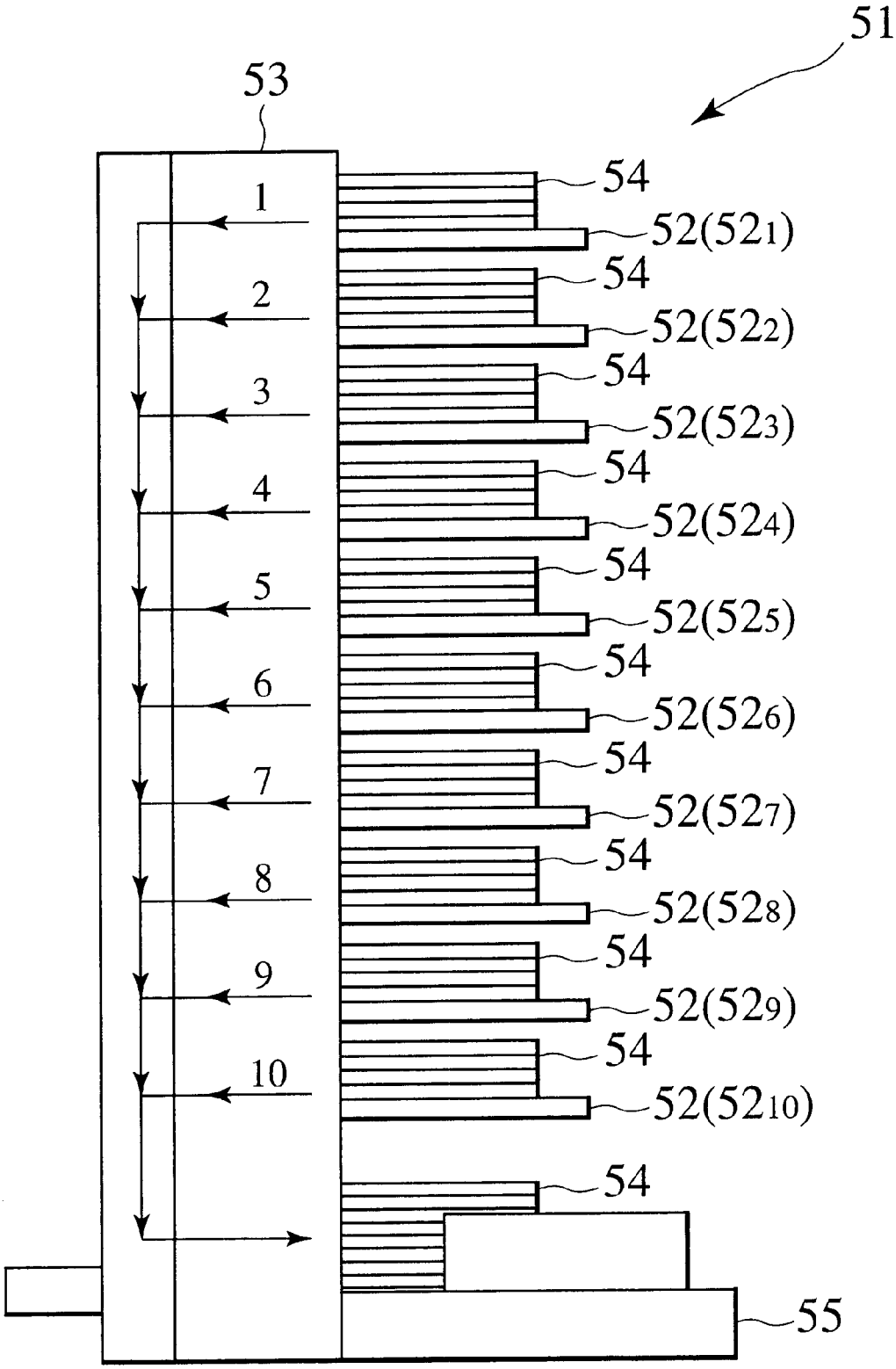
FIG. 6 shows an external view illustrating an entire collator to which the present invention is applied.
Figure 7A:
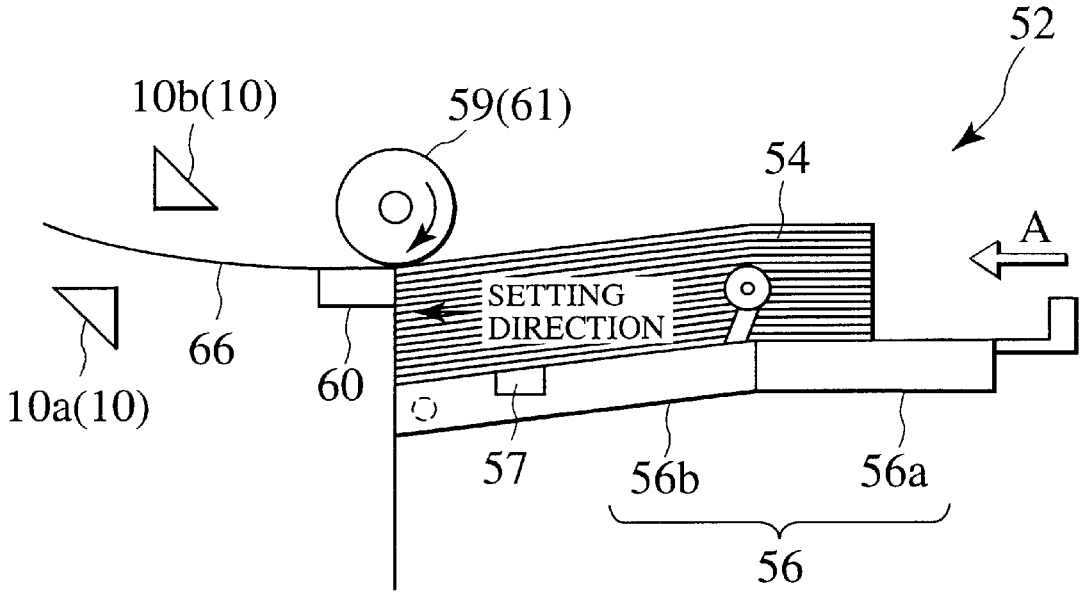
FIG. 7A shows a side view of each bin of the collator in FIG. 6.
Figure 7B:
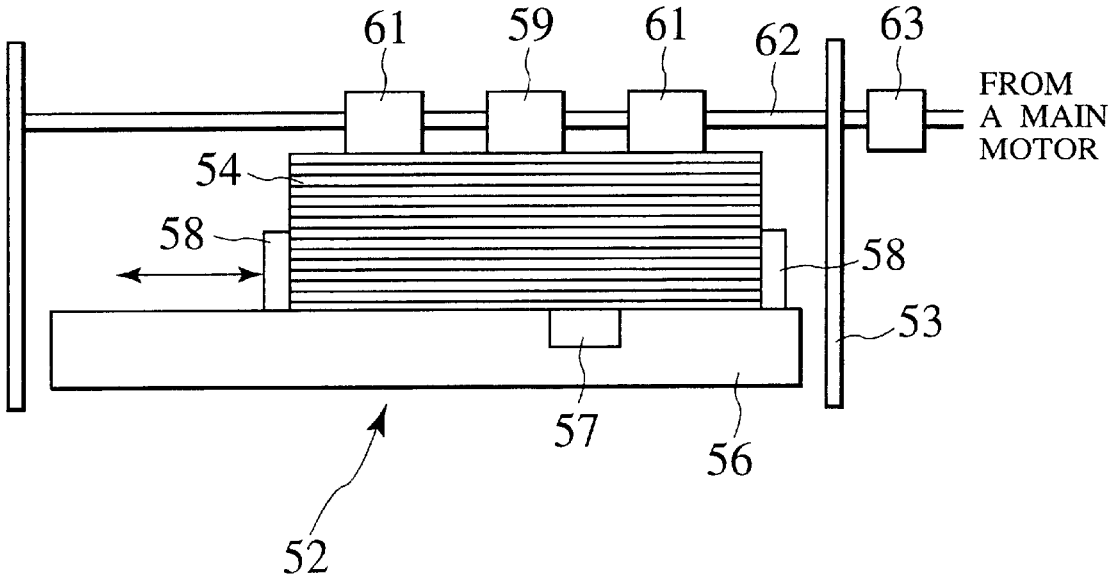
FIG. 7B shows a view illustrating each bin as viewed in the direction indicated by the arrow A in FIG. 7A.

FIG. 6 shows an external view illustrating an entire collator, FIG. 7A shows a partially enlarged sectional view of each bin taken from FIG. 6, and FIG. 7B shows a view illustrating each bin as viewed in the direction indicated by the arrow A in FIG. 7A. In FIG. 6, arrows indicate the flow of sheets for each bin.

A collator 51 comprises a plurality of bins (10 bins in an example of FIG. 6) 52 in which different prints (sheets) 54 are to be set. The bins 52 ($\mathbf{52}_1$ to $\mathbf{52}_{10}$) are arranged in parallel in spaced apart relation provided vertically with respect to a body 53 and disposed to be protruded with a predetermined distance from the front surface of the body 53.

A sheet discharge tray 55 for collating and discharging prints 54 which are fed from each bin 52 one by one is disposed to be protruded with a predetermined distance from the front surface of the body 53 at the lowest part of the body 53. A carriage mechanism is provided inside the body 53, e.g., carrier rollers or carrier belts for carrying the prints 54 fed from each bin 52 onto the sheet discharge tray 55.

Each bin 52 comprises a sheet feed table 56 on which the prints 54 are set. The sheet feed table 56 includes a fixed part 56*a* and a movable part 56*b* which is vertically movable by a shift mechanism driven by a motor (not shown). A sheet-detecting sensor 57 for detecting any presence of the prints 54 to be set, e.g., a reflector-type sensor, is disposed in the movable part 56*b*. A sheet feed fence 58 movable in accordance with the size of the prints 54 to be set is disposed on the sheet feed table 56. The sheet feed fence 58 in FIG. 7B is provided to be fixed at the right side and movable in accordance with the size (width) of the prints at the left side.

A sheet feed roller 59 and a handling plate 60 for carrying the prints 54 set on the sheet feed table 56 one by one from the top to the body 53 are provided to be opposed to one another in each bin 52. Auxiliary rollers 61 for preventing the prints 54 from being deformed are disposed at both sides of the sheet feed roller 59. The rotation axis 62 of the sheet feed roller 59 and the auxiliary rollers 61 is connected through a sheet feed clutch 63 to a main motor (drive motor 26). The sheet feed roller 59 and the auxiliary rollers 61 rotate by means of drive of the main motor in a clockwise direction in FIG. 7A.

In the collator 51 having the above constitution, multiple feed sensors 10 as a sheet detector for detecting a multiple feed of the prints 54 to be fed are disposed around a carriage path 66 between the sheet feed roller 59 of each bin 52 and the carriage mechanism of the body 53.

Apparently from the foregoing descriptions, according to the present invention, unlike the conventional method in which the multiple feed detection is carried out based on the data comparison with only one reference value, the multiple feed detection is carried out based on the data comparison with the reference values for the plurality of sampling ranges set at plural positions in the direction of the sheet feed. Therefore, the frequency of mistakes of the multiple feed detection can be reduced.

The multiple feed detection with higher accuracy can be achieved by the constitution in which a plurality of sheet detectors are arranged in a direction perpendicular to the direction of sheet feed.

If a constitution and a method is employed in which the total number of the sampling ranges is set to be odd, and the final decision of the multiple detection is made when the number of sampling ranges for which a multiple feed was detected is more than half of the total number, the detection results for the plurality of the sampling ranges are totally considered to thus output a reliable result of the multiple feed detection.

If a constitution and a method is employed in which the occurrence of the multiple detection is determined when successive results that multiple feeds are detected are obtained starting from a front end sampling range on the sheet, a final result of the multiple feed detection is output at once when successive multiple feeds for a plurality of successive sampling ranges are detected.

In a case in which an apparatus and a method of detecting a multiple feed according to the present invention is applied to, e.g., a collator with a plurality of bins, if the plurality of the plural sampling ranges for the plurality of bins are arranged in a direction of sheet feed, the sample start timings for the plurality of bins can be distributed to reduce a load on a CPU, thereby achieving improved functionality, e.g., the increase in the number of samplings.

It should be understood that many modifications and adaptations of the invention will become apparent to those skilled in the art and it is intended to encompass such obvious modifications and changes in the scope of the claims appended hereto.

What is claimed is:

1. A multiple feed detection device comprising:

a sheet detector having a light emitting sensor and a light receiving sensor arranged in vicinity of a carriage path to detect quantity of light that has transmitted through a sheet; and a processor which controls said sheet detector to detect a predetermined number of a plurality of samples of light quantities for each of a plurality of sampling ranges defined on one sheet, detects a multiple feed for each sample range based on light quantity data sampled for each sampling range, and decides the multiple feed of sheets based on a plurality of results of the detection of the multiple feed for the plurality of sampling ranges.

2. The multiple feed detection device according to claim 1, wherein said plurality of sampling ranges are arranged in the direction of sheet feed, and said processor conducts the samplings for said plurality of sampling ranges sequentially at predetermined sampling start timings by means of a pair of the light emitting sensor and the light receiving sensor.

3. The multiple feed detection device according to claim 1, wherein a plurality of sheet detectors are arranged in a direction perpendicular to the direction of sheet feed.

4. The multiple feed detection device according to claim 1, wherein said processor sets a total number of said plurality of sampling ranges to be odd in advance, and decides that the multiple feed has occurred when the number of sampling ranges for which the multiple feed is detected is more than half of the total number.

5. The multiple feed detection device according to claim 1, wherein said processor decides that the multiple feed has occurred when successive results that multiple feeds are detected are obtained starting from a front end sampling range on the sheet.

6. A multiple feed detection method comprising the steps of:

arranging a sheet detector having a light emitting sensor and a light receiving sensor in vicinity of a carriage path to detect a quantity of light that has transmitted through a sheet;

controlling said sheet detector to detect a predetermined number of a plurality of samples of light quantities for each of a plurality of sampling ranges defined on one sheet;

detecting a multiple feed for each sampling range based on light quantity data sampled for each sampling range; and deciding the multiple feed of sheets based on a plurality of results of the detection of the multiple feed for the plurality of sampling ranges.

7. The multiple feed detection method according to claim 6, wherein said plurality of sampling ranges are arranged in the direction of sheet feed, and the samplings for said plurality of sampling ranges are sequentially conducted at predetermined sampling start timings by means of a pair of the light emitting sensor and the light receiving sensor.

8. The multiple feed detection method according to claim 6, wherein a total number of said plurality of sampling ranges is set to be odd in advance, and it is decided that the multiple feed has occurred when the number of sampling ranges for which the multiple feed is detected is more than half of the total number.

9. The multiple feed detection method according to claim 6, wherein it is decided that the multiple feed has occurred when successive results that multiple feeds are detected are obtained starting from a front end sampling range on the sheet.

* * * * *